US006696801B2

(12) United States Patent
Schmitkons et al.

(10) Patent No.: US 6,696,801 B2
(45) Date of Patent: Feb. 24, 2004

(54) MICROWAVE EXCITED ULTRAVIOLET LAMP SYSTEM WITH IMPROVED LAMP COOLING

(75) Inventors: James W. Schmitkons, Lorain, OH (US); James M. Borsuk, Westlake, OH (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/182,164

(22) PCT Filed: Apr. 6, 2001

(86) PCT No.: PCT/US01/11409

§ 371 (c)(1),
(2), (4) Date: Jul. 25, 2002

(87) PCT Pub. No.: WO01/80271

PCT Pub. Date: Oct. 25, 2001

(65) Prior Publication Data

US 2003/0020414 A1 Jan. 30, 2003

Related U.S. Application Data

(60) Provisional application No. 60/195,566, filed on Apr. 7, 2000.

(51) Int. Cl.[7] ..... B02D 3/06

(52) U.S. Cl. ..... 315/248; 392/417

(58) Field of Search ..... 315/248, 39, 111.1; 313/231.5, 231.6; 392/417, 423, 411; 427/493, 513; 250/492.1; 118/641, 642, 643; 219/388

(56) References Cited

U.S. PATENT DOCUMENTS

| | | | | |
|---|---|---|---|---|
| 4,042,850 A | | 8/1977 | Ury et al. | 315/39 |
| 4,504,768 A | | 3/1985 | Ury et al. | 315/248 |
| 4,695,757 A | | 9/1987 | Ury et al. | 313/44 |
| 4,965,876 A | | 10/1990 | Foldi et al. | 362/247 |
| 4,990,789 A | | 2/1991 | Uesaki | 250/504 |
| 5,504,391 A | | 4/1996 | Turner et al. | 313/570 |
| 6,345,149 B1 | * | 2/2002 | Ervin et al. | 392/417 |

* cited by examiner

*Primary Examiner*—James Clinger
(74) *Attorney, Agent, or Firm*—Wood, Herron & Evans, LLP

(57) ABSTRACT

A reflector (42) for use in a microwave excited ultra-violet lamp system (10) having a plasma lamp bulb (20). The reflector (42) includes a pair of longitudinally extending reflector panels (46) that are mounted in opposing, i.e., mirror facing relationship, and in space relationship to the plasma lamp bulb (20). A longitudinally extending intermediate member (52) is mounted in spaced relationship to the pair of reflector panels (46) and to the plasma lamp bulb (20). The reflector panels (46) and the intermediate member (52) form a pair of longitudinally extending slots (64) that are operable to pass air toward the plasma lamp bulb (20) to envelop the bulb (20) effectively entirely about its outer surface. Alternatively, the pair of reflector panels **(46*e*) are connected to longitudinally extending edges (58*e*) of the intermediate member (52*e*). The intermediate member (52*e*) includes multiple apertures (78) formed therethrough that are operable to pass air toward the bulb (20) to envelope the bulb (20) effectively entirely about its outer surface. A method of cooling a plasma lamp bulb (20) in a microwave excited ultraviolet lamp system (10)** is also disclosed.

17 Claims, 8 Drawing Sheets

MICROWAVE EXCITED ULTRAVIOLET LAMP SYSTEM WITH IMPROVED LAMP COOLING

The present application claims the filing benefit of U.S. provisional application Serial No. 60/195,566, filed Apr. 7, 2000, the disclosure of which is hereby incorporated herein by reference in its entirety.

FIELD OF THE INVENTION

The present invention relates generally to microwave excited ultraviolet lamp systems and, more particularly, to a reflector for use in such lamp systems to reflect ultraviolet radiation generated by a plasma lamp bulb mounted within the system.

BACKGROUND OF THE INVENTION

Ultraviolet lamp systems are designed for coupling microwave energy to an electrodeless lamp, such as an ultraviolet (UV) plasma lamp bulb mounted within a microwave chamber of the lamp system. In ultraviolet lamp heating and curing applications, one or more magnetrons are typically provided in the lamp system to couple microwave radiation to the plasma lamp bulb within the microwave chamber. The magnetrons are coupled to the microwave chamber through waveguides that include output ports connected to an upper end of the chamber. When the plasma lamp bulb is sufficiently excited by the microwave energy, it emits ultraviolet radiation through a bottom end of the microwave chamber. UV lamp systems used in curing of adhesives, sealants or coatings, for example, include a reflector mounted within or that form a part of the microwave chamber in which the plasma lamp bulb is positioned. The reflector may be made of coated glass or metallic, and is operable to focus the emitted ultraviolet radiation in a predetermined pattern toward the substrate to be irradiated. Typically, the ultraviolet lamp system includes a mesh screen mounted to the bottom end of the chamber that is transmissive to ultraviolet radiation but is opaque to the microwaves generated by the magnetrons. It will be appreciated that the terms "upper end" and "bottom end" are used herein to simplify description of the microwave chamber in connection with the orientation of the chamber as shown in the figures. Of course, the orientation of the microwave chamber may change depending on the particular ultraviolet lamp heating or curing application without altering the structure or function of the microwave chamber in any way.

In UV lamp systems, the plasma lamp bulb is cooled by pressurized air that is supplied by a pressurized air source associated with the lamp system. In most lamp system designs, the pressurized air must pass through the reflector to the region of the microwave cavity in which the plasma lamp bulb is mounted. In those designs that use a metallic reflector that also forms part of the microwave chamber, the reflector may include one or more longitudinally extending rows of apertures formed through the reflector that are operable to pass air toward the plasma lamp bulb. The longitudinally extending rows of apertures are typically aligned generally parallel with the longitudinal axis of the plasma lamp bulb, and the apertures may have many different shapes and sizes.

Alternatively, when the reflector is made of coated glass in which it is generally too costly to form apertures through the glass, the reflector is typically constructed as two reflector panels with a single longitudinally extending slot formed between the reflector panels that is generally aligned with the longitudinal axis of the plasma lamp bulb. With this reflector configuration, the slot is operable to pass air toward the plasma lamp bulb so that the air splits about opposite longitudinal sides of the bulb to cool the bulb. However, this reflector configuration has the drawback that the air does not envelop the bulb effectively entirely about its outer surface, so regions of the bulb, particularly the region on the underside of the bulb remote from the slot, are not sufficiently cooled by the air. As a result, the operating life of the plasma lamp bulb may be diminished and/or the volume of air passed through the slot must be increased to achieve sufficient cooling of the bulb.

Thus, there is a need for a reflector that is configured to efficiently pass air toward a plasma lamp bulb in a microwave excited ultraviolet lamp system to cool the bulb. There is also a need for a reflector configuration that reduces the amount of cooling air required to operate the plasma lamp bulb at a predetermined power level. There is also a need for a reflector configuration that improves the operating life of the plasma lamp bulb.

SUMMARY OF THE INVENTION

The present invention overcomes the foregoing and other shortcomings and drawbacks of reflectors heretofore known in microwave excited ultraviolet lamp systems. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, the reflector includes a pair of reflector panels that are mounted in opposing, i.e., mirror facing relationship within the microwave chamber, and in spaced relationship to the plasma lamp bulb. A longitudinally extending intermediate member is mounted in spaced relationship to the pair of reflector panels and to the plasma lamp bulb. The pair of reflector panels and the intermediate member form in mounted combination a pair of longitudinally extending slots that are operable to pass air toward the plasma lamp bulb. The pair of slots are positioned relative to the plasma lamp bulb so that the air envelops the plasma lamp bulb effectively entirely about its outer surface. The pair of slots are oriented so that the air passes along opposite longitudinal sides of the plasma lamp bulb and then merges generally in a region beneath the bulb that is remote form the pair of slots.

In accordance with one aspect of the present invention, the pair of longitudinally extending slots may be aligned generally parallel to and offset from the longitudinal axis of the plasma lamp bulb. Alternatively, each of the longitudinally extending slots may have a sinusoidal or other configuration that is also operable to pass the air toward the bulb so that the air envelops the bulb effectively entirely about is outer surface to cool the bulb.

In accordance with another aspect of the present invention, a reflector is provided that includes a pair of reflector panels that are mounted in opposing relationship, and that are connected to opposite longitudinal edges of the intermediate member. In this reflector configuration, the intermediate member includes multiple apertures formed therethrough that are operable to pass air toward the plasma lamp bulb to envelop the bulb effectively entirely about its outer surface. The apertures may be provided in two longitudinally extending rows that are generally parallel to and offset from the longitudinal axis of the plasma lamp bulb.

The apertures of one row may be staggered relative to the apertures of the other row.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
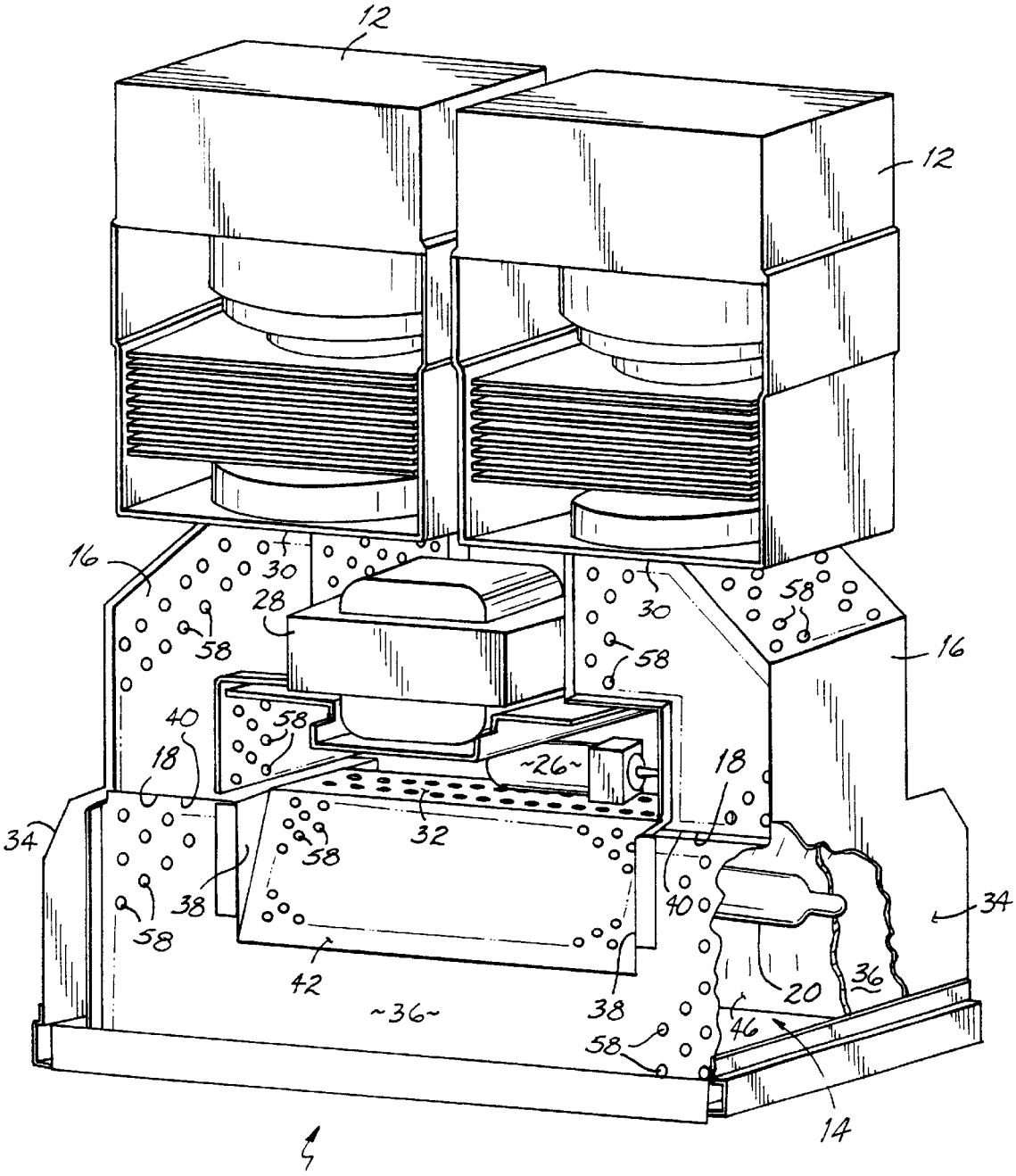
FIG. 1 is a perspective view of a microwave excited ultraviolet lamp system in accordance with the principles of the present invention.

With reference to the figures, a microwave excited ultraviolet ("UV") lamp system or light source 10 is shown in accordance with the principles of the present invention. Light source 10 includes a pair of microwave generators, illustrated as a pair of magnetrons 12, that are each coupled to a longitudinally extending microwave chamber 14 through a respective waveguide 16. Each waveguide 16 has an outlet port 18 coupled to an upper end of the microwave chamber 14 so that microwaves generated by the pair of microwave generators 12 are coupled to the microwave chamber 14 in spaced longitudinal relationship adjacent opposite upper ends of the chamber 14. An electrodeless plasma lamp 20, in the form of a sealed, longitudinally extending plasma bulb, is mounted within the microwave chamber 14 and supported adjacent the upper end of the chamber 14 as is well known in the art. While not shown, it will be appreciated that light source 10 is mounted within a cabinet or housing well known to those of ordinary skill in the art that includes a source of pressurized air that is operable to direct air into the microwave chamber 14, represented diagrammatically by arrows 22 in FIG. 2, to cool the plasma lamp bulb 20 as will be described in greater detail below.

Figure 2:
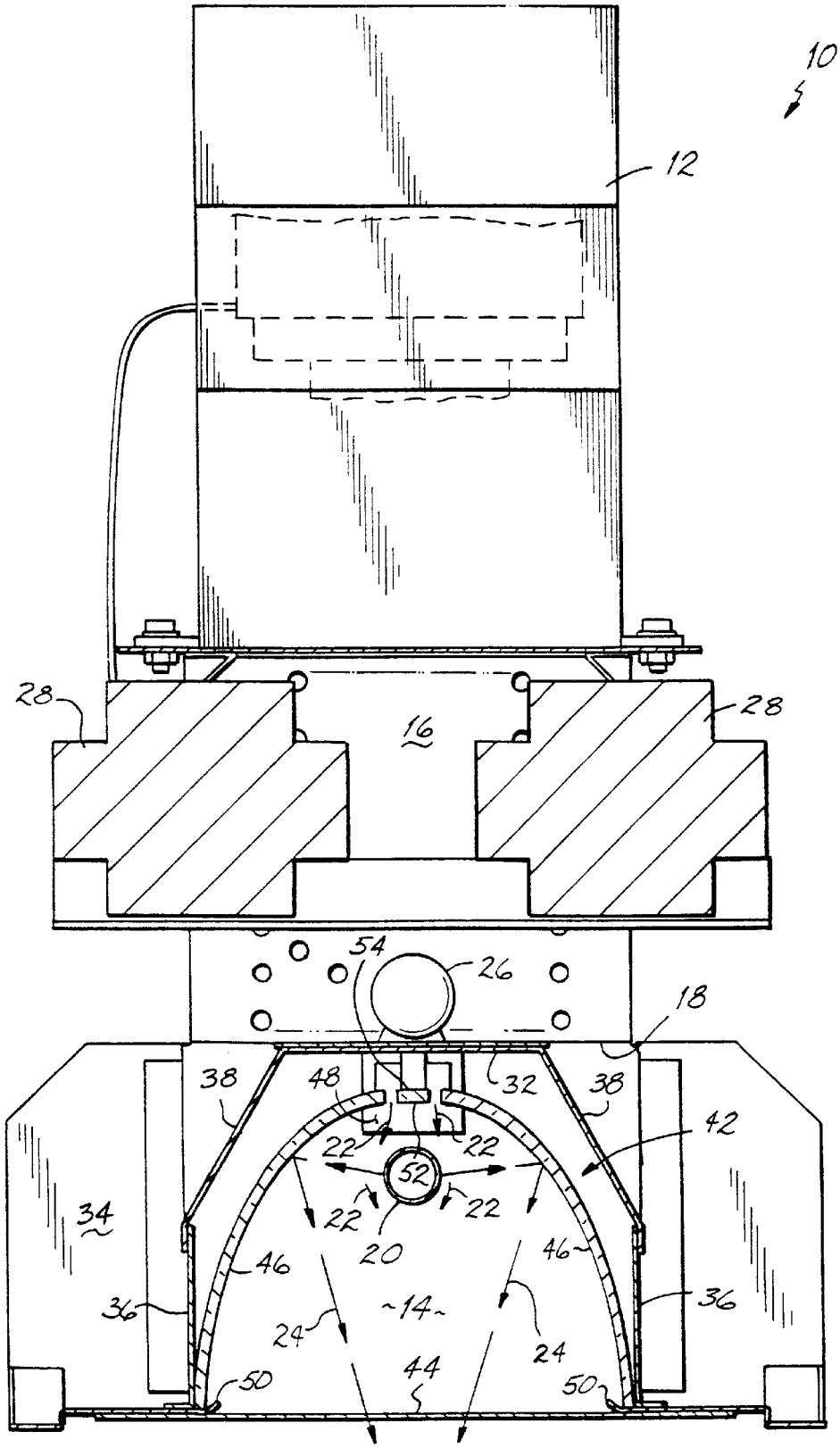
FIG. 2 is a cross-sectional view of the ultraviolet lamp system of FIG. 1 taken along line 2—2 of FIG. 1.

Light source 10 is designed and constructed to emit ultraviolet radiation, illustrated diagrammatically by arrows 24 in FIG. 2, from a bottom end of the microwave chamber 14 upon sufficient excitation of the plasma lamp bulb 20 by microwave energy coupled to the microwave chamber 14 from the pair of microwave generators 12. While a pair of magnetrons 12 are illustrated and described herein, it is to be understood that the light source 10 may include only a single magnetron 12 to excite the plasma lamp bulb 20 without departing from the spirit and scope of the present invention.

Light source 10 includes a starter bulb 26, and a pair of transformers 28 that are each electrically coupled to a respective one of the magnetrons 12 to energize filaments of the magnetrons 12 as understood by those skilled in the art. The magnetrons 12 are mounted to inlet ports 30 of the waveguides 16 so that microwaves generated by the magnetrons 12 are discharged into the chamber 14 through the longitudinally spaced apart outlet ports 18 of the waveguides 16. Preferably, the frequencies of the two magnetrons 12 are split or offset by a small amount to prevent intercoupling between them during operation of the light source 10.

As best understood with reference to FIGS. 1 and 2, microwave chamber 14 includes a generally horizontal top wall 32, a pair of generally vertical opposite end walls 34, and a pair of generally vertical opposite side walls 36 that extend longitudinally between the end walls 34 and on opposite sides of the plasma lamp bulb 20. Microwave chamber 14 further includes inclined walls 38 that extend upwardly and inwardly from the side walls 36 toward the top wall 32. A pair of openings 40 are provided at an upper end of the microwave chamber 14 that are aligned with and coupled to the outlet ports 18 of the waveguides 16. In this way, microwave energy generated by the pair of magnetrons 12 is coupled to the microwave chamber 14 to excite the plasma lamp bulb 20 with sufficient energy to emit ultraviolet radiation. Of course, other configurations of the microwave chamber 14 are possible without departing from the spirit and scope of the present invention.

In accordance with the principles of the present invention, a longitudinally extending reflector 42 is mounted within the microwave chamber 14 for reflecting the ultraviolet radiation 24 emitted from the plasma lamp bulb 20 toward a substrate (not shown) from the bottom end of the microwave chamber 14. Reflector 42 preferably has an elliptical configuration in transverse cross-section, although parabolic or other cross-sectional configurations are possible without departing from the spirit and scope of the present invention. A mesh screen 44 is mounted to the bottom end of the microwave chamber 14 that is transparent to the emitted ultraviolet radiation 24 while remaining opaque to the microwaves generated by the pair of magnetrons 12.

Figure 3:
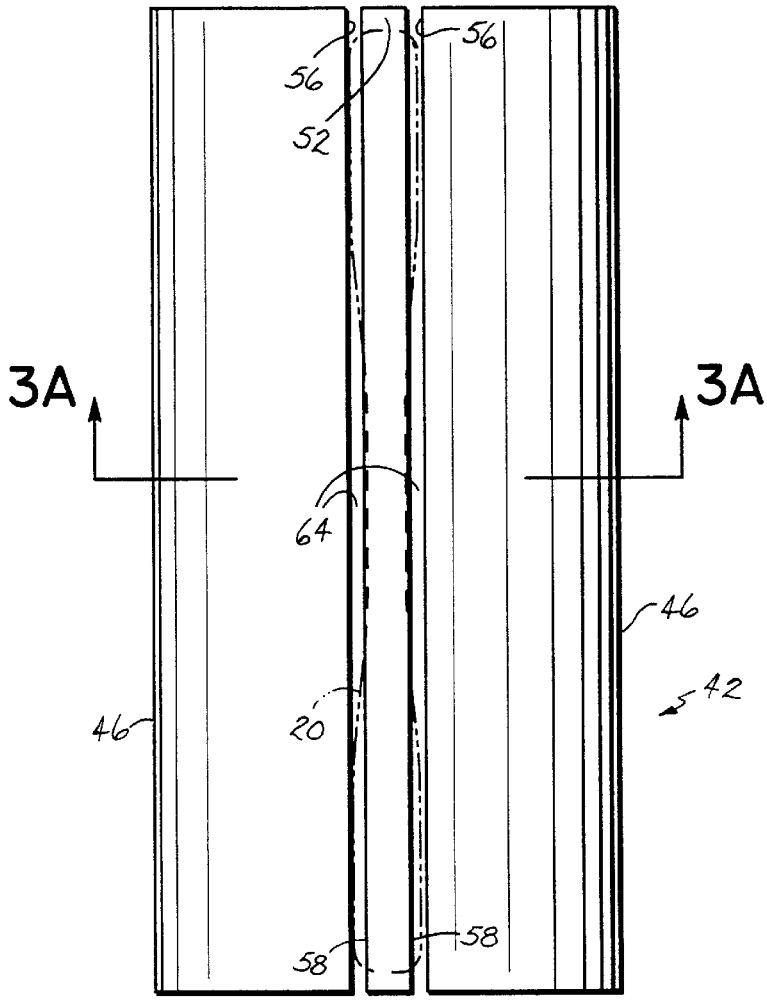
FIG. 3 is a top plan view of a reflector for use in the ultraviolet lamp system of FIG. 1 in accordance with a first aspect of the present invention.
Figure 3A:
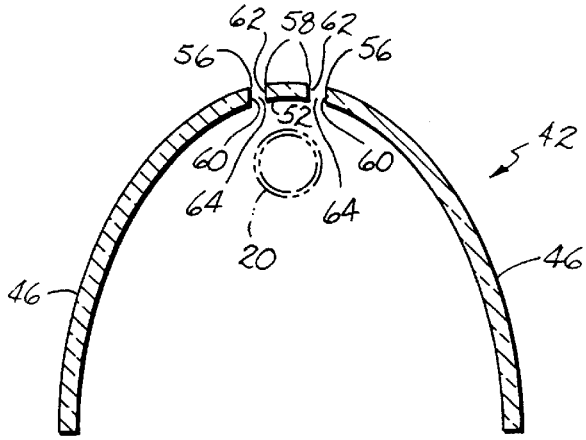
FIG. 3A is a cross-sectional view taken along line 3A—3A of FIG. 3.

In accordance with one aspect of the present invention, as shown in FIGS. 2, 3 and 3A, reflector 42 includes a pair of longitudinally extending reflector panels 46 that are mounted in opposing, i.e., mirror facing relationship within the microwave chamber 14 and in spaced relationship to the plasma lamp bulb 20. Each reflector panel 46 is preferably made of coated glass, although other materials having suitable reflective and thermal properties are possible as well.

When made of coated glass, for example, each reflector panel 46 is transparent to the microwave energy generated by the pair of magnetrons 12 but opaque to and reflective of the ultraviolet radiation 24 emitted by the plasma lamp bulb 20.

The pair of reflector panels 46 are mounted within the microwave chamber 14 through a pair of longitudinally spaced apart retainers 48 (FIG. 2), and each reflector panel 46 has its lower end supported on a generally horizontal, inwardly directed flange 50 that extends inwardly from the each chamber side wall 36. In accordance with one aspect of the present invention, a longitudinally extending intermediate member 52 is mounted within the microwave chamber 14 through a pair of slots 54 (FIG. 2) formed in the retainers 48. As shown in FIGS. 2, 3 and 3A, the intermediate member 52 is mounted in spaced relationship to the reflector panels 46, and also in spaced relationship to the plasma lamp bulb 20. The intermediate member 52 may be made of glass, such as PYREX®, and may uncoated to be non-reflective of the ultraviolet radiation 24 emitted by the plasma lamp bulb 20.

Further referring to FIGS. 2, 3 and 3A, each of the reflector panels 46 includes a longitudinally extending edge 56 that is generally parallel to a longitudinal axis of the respective reflector panel 46. The intermediate member 52 includes a pair of longitudinally extending opposite edges 58 that are each generally parallel to a longitudinal axis of the intermediate member 52. Each of the reflector panel edges 56 and intermediate member edges 58 preferably has a vertical face 60 and 62, respectively, that is generally parallel to the longitudinal axis of the plasma lamp bulb 20.

When the pair of reflector panels 46 and the intermediate member 52 are mounted in combination within the microwave chamber 14 to form the reflector 42, a pair of spaced, longitudinally extending slots 64 are formed between the edges 56 of the reflector panels 46 and the edges 58 of the intermediate member 52. In accordance with the principles of the present invention, the pair of spaced, longitudinally extending slots 64 are operable to pass air, represented by arrows 22 in FIG. 2, from the pressurized air source (not shown) toward the plasma lamp bulb 20. The slots 64 are preferably aligned generally parallel with and offset from the longitudinal axis of the plasma lamp bulb 20 so that the air 22 envelops the plasma lamp bulb 20 effectively entirely about its outer surface to cool the bulb 20. The pair of slots 64 are oriented so that the air passes along opposite longitudinal sides of the plasma lamp bulb 20 and then merges generally in a region beneath the bulb 20 that is remote form the pair of slots 64.

Figure 6:
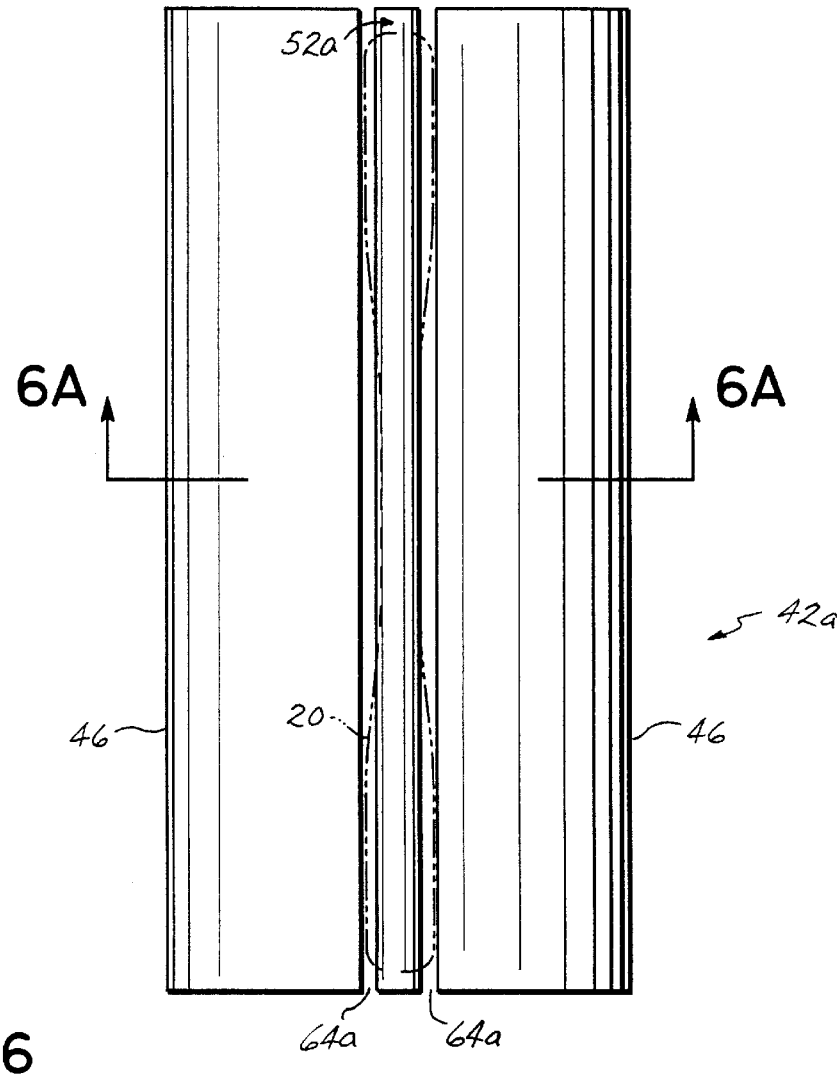
FIG. 6 is a view similar to FIG. 3, illustrating a reflector in accordance with a fourth aspect of the present invention.
Figure 6A:
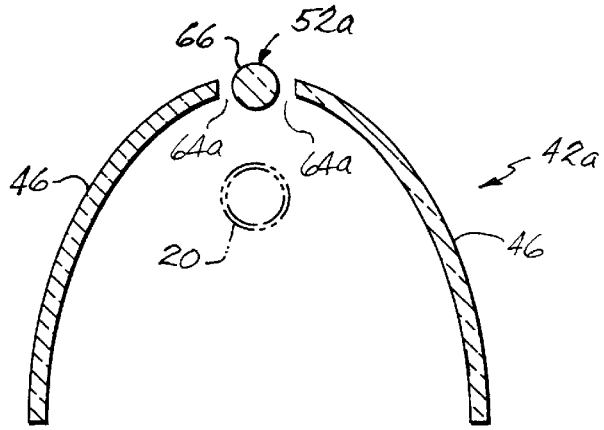
FIG. 6A is a cross-sectional view taken along line 6A—6A of FIG. 6.

As shown in FIGS. 2, 3 and 3A, the intermediate member 52, while having a slight curvature transverse to its longitudinal axis, is formed generally as rectangular strip of material and has a generally rectangular transverse cross-sectional configuration as shown in FIGS. 3 and 3A. Alternatively, and in accordance with another aspect of the present invention as shown in FIGS. 6 and 6A, a longitudinally extending intermediate member 52*a* may be provided in the form of a glass rod that has a generally circular configuration in transverse cross-section. According to this aspect of the present invention, the intermediate member 52*a* is also positioned in spaced relationship to the pair of reflector panels 46, and in spaced relationship to the plasma lamp bulb 20. The intermediate member 52*a* has a longitudinal axis that is generally parallel to each longitudinal axis of the respective reflector panels 46.

When the pair of reflector panels 46 and the intermediate member 52*a* are mounted in combination within the microwave chamber 14 to form the reflector 42*a* as shown in FIGS. 6 and 6A, a pair of spaced, longitudinally extending slots 64*a* are formed between the edges 56 of the reflector panels 46 and the cylindrical surface 66 of the intermediate member 52*a*. The pair of spaced, longitudinally extending slots 64*a* are operable to pass air toward the plasma lamp bulb 20 as discussed in detail above with reference to FIGS. 2, 3 and 3A. The slots 64*a* are also preferably aligned generally parallel with and offset from the longitudinal axis of the plasma lamp bulb 20 so that the air envelops the plasma lamp bulb 20 effectively entirely about its outer surface to cool the bulb 20. Of course, other geometric configurations of the intermediate member 52*a* are possible to achieve a similar result without departing from the spirit and scope of the present invention.

Figure 4:
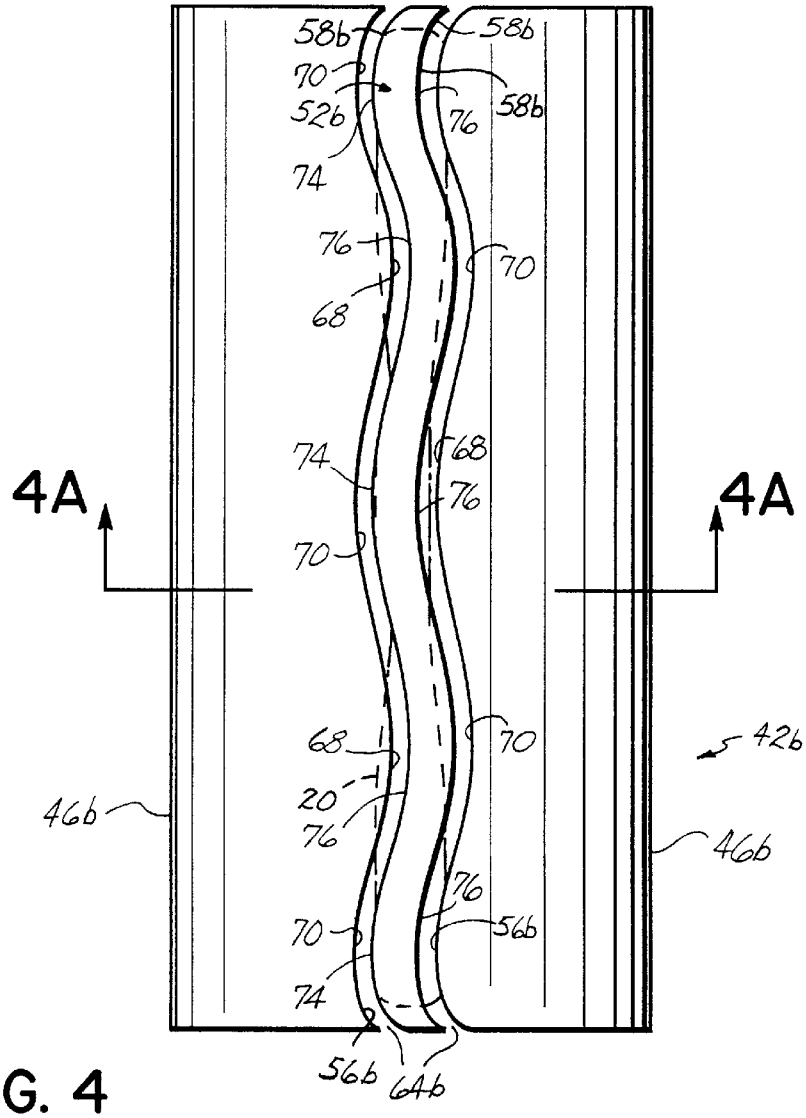
FIG. 4 is a view similar to FIG. 3, illustrating a reflector in accordance with a second aspect of the present invention.
Figure 4A:
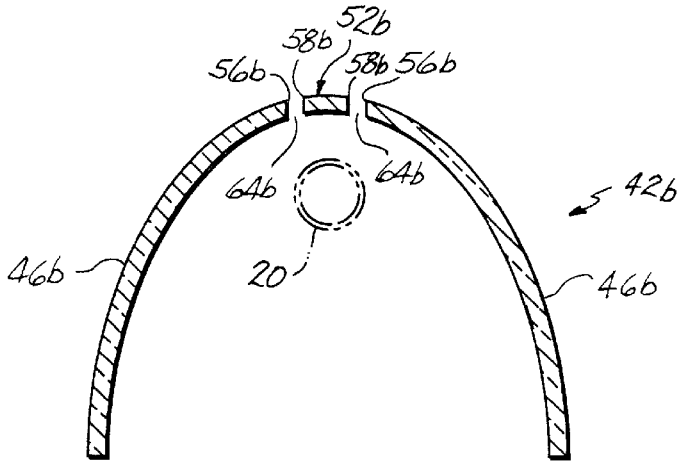
FIG. 4A is a cross-sectional view taken along line 4A—4A of FIG. 4.

Referring now to FIGS. 4 and 4A, a longitudinally extending reflector 42*b* is shown in accordance with another aspect of the present invention. Reflector 42*b* includes a pair of longitudinally extending reflector panels 46*b* that are mounted in opposing relationship within the microwave chamber 14 and in spaced relationship to the plasma lamp bulb 20. A longitudinally extending intermediate member 52*b* is mounted in spaced relationship to the pair of reflector panels 46*b*, and in spaced relationship to the plasma lamp bulb 20.

Each of the reflector panels 46*b* includes a longitudinally extending edge 56*b* that is provided with one or more projections 68 and/or recesses 70 formed along the longitudinal length of the edge 56*b*. The intermediate member 52*b* includes a pair of longitudinally extending opposite edges 58*b* that are each provided with one or more projections 74 and/or recesses 76 formed along the longitudinal length of the edge 58*b*. As shown in FIG. 4, the reflector panel edges 56*b* and intermediate member edges 58*b* have a generally sinusoidal configuration, and the projections 68 formed along the length of the reflector panel edges 56*b* are mounted in opposing relationship to the recesses 76 formed along the length of the intermediate member edges 58*b*.

When the pair of reflector panels 56*b* and the intermediate member 52*b* are mounted in combination within the microwave chamber 14 to form the reflector 42*b*, a pair of spaced, longitudinally extending slots 64*b* are formed between the edges 56*b* of the reflector panels 46*b* and the edges 58*b* of the intermediate member 52*b* that are operable to pass air toward the plasma lamp bulb 20 to envelop the bulb 20 effectively entirely about its outer surface. As shown in FIG. 4A, each of the slots 64*b* has a generally sinusoidal configuration and is generally offset from the longitudinal axis of the plasma lamp bulb 20. The slots 64*b* are configured to vary the flow of air along the longitudinal length of the plasma lamp bulb 20. Of course, other configurations of the reflector panel edges 56*b* and intermediate member edges 58*b* to form the pair of slots 64*b* are possible to achieve a similar result without departing from the spirit and scope of the present invention.

Figure 5:
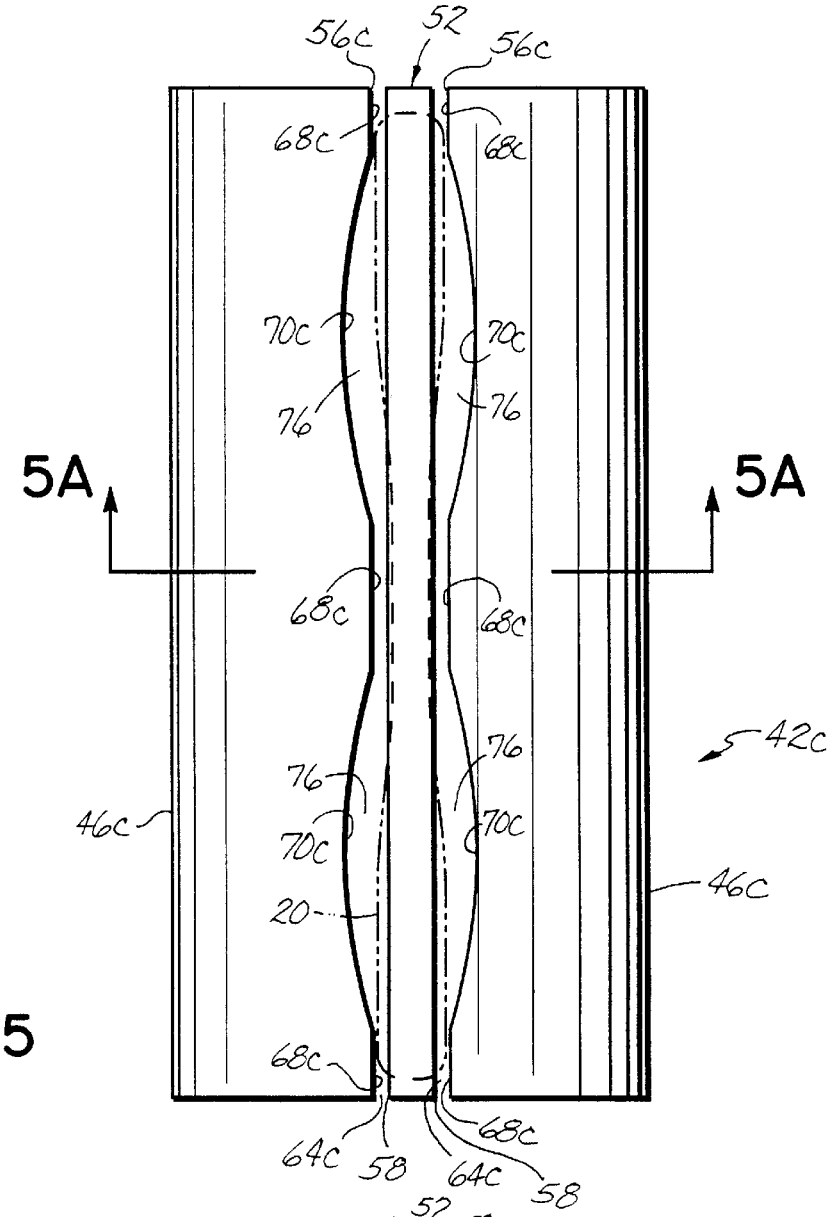
FIG. 5 is a view similar to FIG. 3, illustrating a reflector in accordance with a third aspect of the present invention.
Figure 5A:
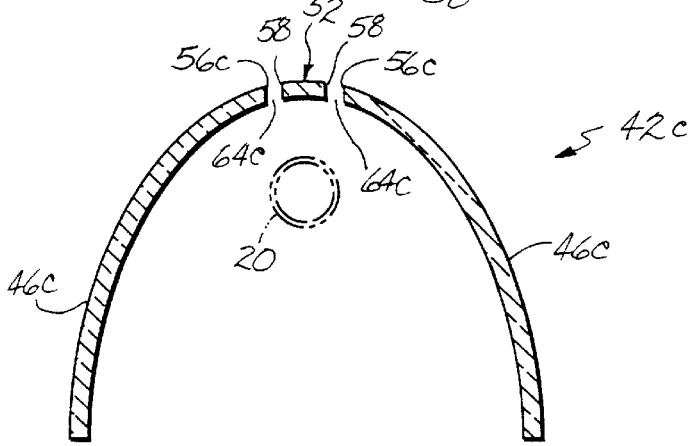
FIG. 5A is a cross-sectional view taken along line 5A—5A of FIG. 5.

Referring now to FIGS. 5 and 5A, a longitudinally extending reflector 42*c* in accordance with another aspect of the present invention is shown. Reflector 42*c* includes a pair of longitudinally extending reflector panels 46*c* and a longitudinally extending intermediate member 52 mounted in the microwave chamber 14 as generally discussed above with reference to the reflectors 42, 42*a* and 42*b*. In this embodiment, each of the reflector panels 46*c* is provided with one or more projections 68*c* and/or recesses 70*c* formed along the longitudinal length of the edge 56*c*. The intermediate member 52 includes a pair of longitudinally extending opposite edges 58 that are each generally parallel to the longitudinal axis of the intermediate member 52. The reflector panels 46*c* are mounted in spaced relationship to the intermediate member 52 so that the projections 68*c* formed along one of the reflector panel edges 56*c* are in opposing relationship to the projections 68*c* formed along the other reflector panel edge 56*c*.

When the pair of reflector panels 46*c* and the intermediate member 52 are mounted in combination within the microwave chamber 14 to form the reflector 42*c*, a pair of spaced, longitudinally extending slots 64*c* are formed between the edges 56*c* of the reflector panels 46*c* and the edges 58 of the intermediate member 52 that are operable to pass air toward the plasma lamp bulb 20 to envelop the bulb 20 effectively entirely about is outer surface. As shown in FIG. 5A, each of the slots 64*c* has an enlarged region 76 that is positioned along the length of the plasma lamp bulb 20 to direct a greater volume of air in particular zones along the length of the bulb 20. Preferably, these zones of increased air volume coincide generally with the hot zones of the bulb 20.

Figure 8:
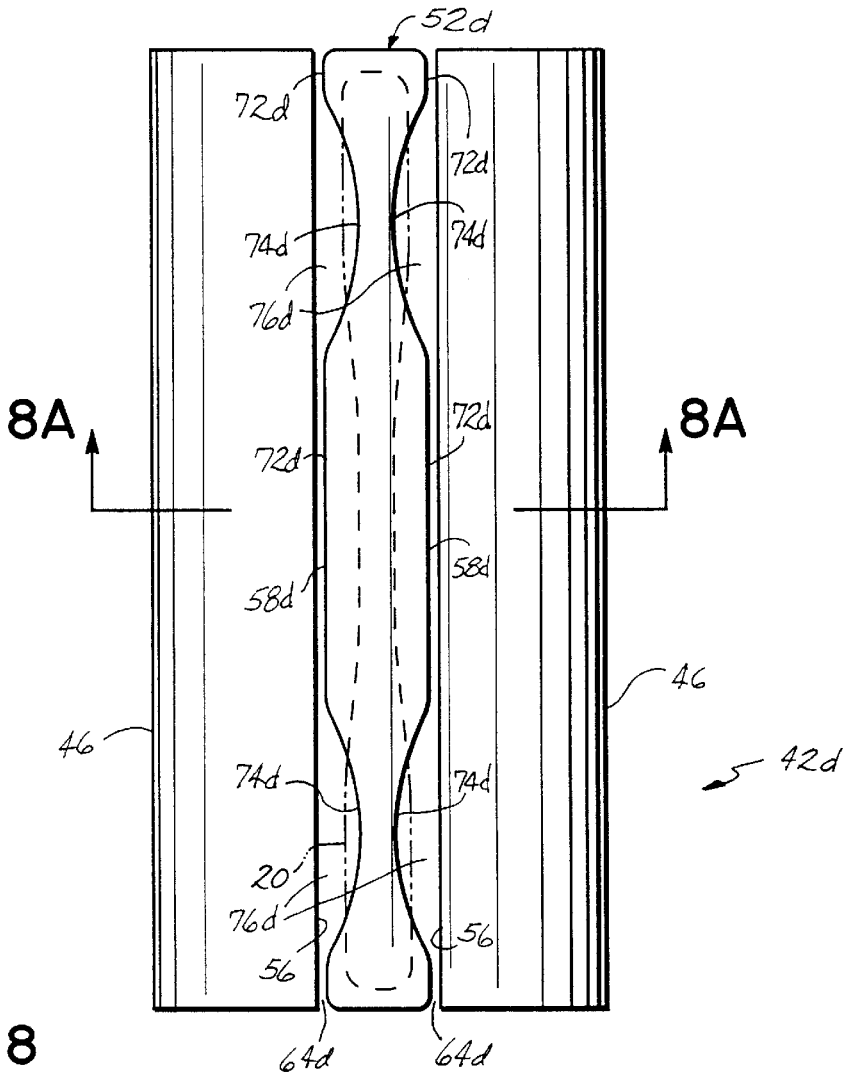
FIG. 8 is a view similar to FIG. 3, illustrating a reflector in accordance with a sixth aspect of the present invention.
Figure 8A:
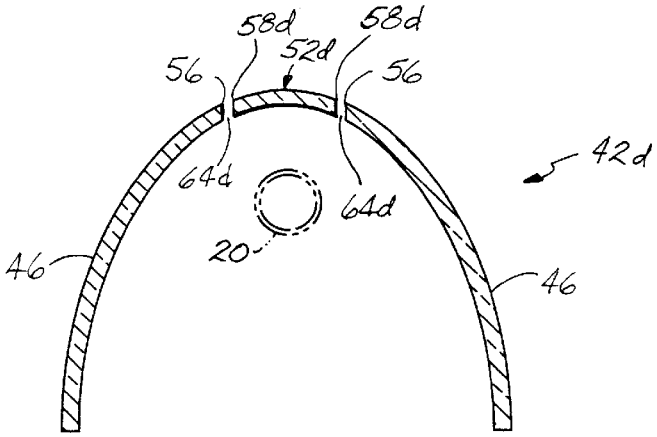
FIG. 8A is a cross-sectional view taken along line 8A—8A of FIG. 8.

Alternatively, in accordance with another aspect of the present invention as shown in FIGS. 8 and 8A, a longitudinally extending reflector 42*d* is shown. Reflector 42*d* includes a pair of longitudinally extending reflector panels 46 and a longitudinally extending intermediate member 52*d* mounted in the microwave chamber 14 as generally discussed above with reference to the reflectors 42, and 42*a–c*. In this embodiment, each of the reflector panels 46 has a longitudinally extending edge 56 that is generally parallel to the longitudinal axis of the reflector panel 46. The intermediate member 52*d* includes a pair of longitudinally extending opposite edges 58*d* that are each provided with one or more projections 72*d* and/or recesses 74*d*.

When the pair of reflector panels 46 and the intermediate member 52*d* are mounted in combination within the microwave chamber 14 to form the reflector 42*d*, a pair of spaced, longitudinally extending slots 64*d* are formed between the edges 56 of the reflector panels 46 and the edges 58*d* of the intermediate member 52*d* that are operable to pass air toward the plasma lamp bulb 20 to envelop the bulb 20 effectively entirely about is outer surface. As shown in FIG. 8A, each of the slots 64*d* has an enlarged region 76*d* that is positioned along the length of the plasma lamp bulb 20 to direct a greater volume of air in particular zones along the length of the bulb 20. Preferably, these zones of increased air volume coincide generally with the hot zones of the bulb 20.

Figure 7:
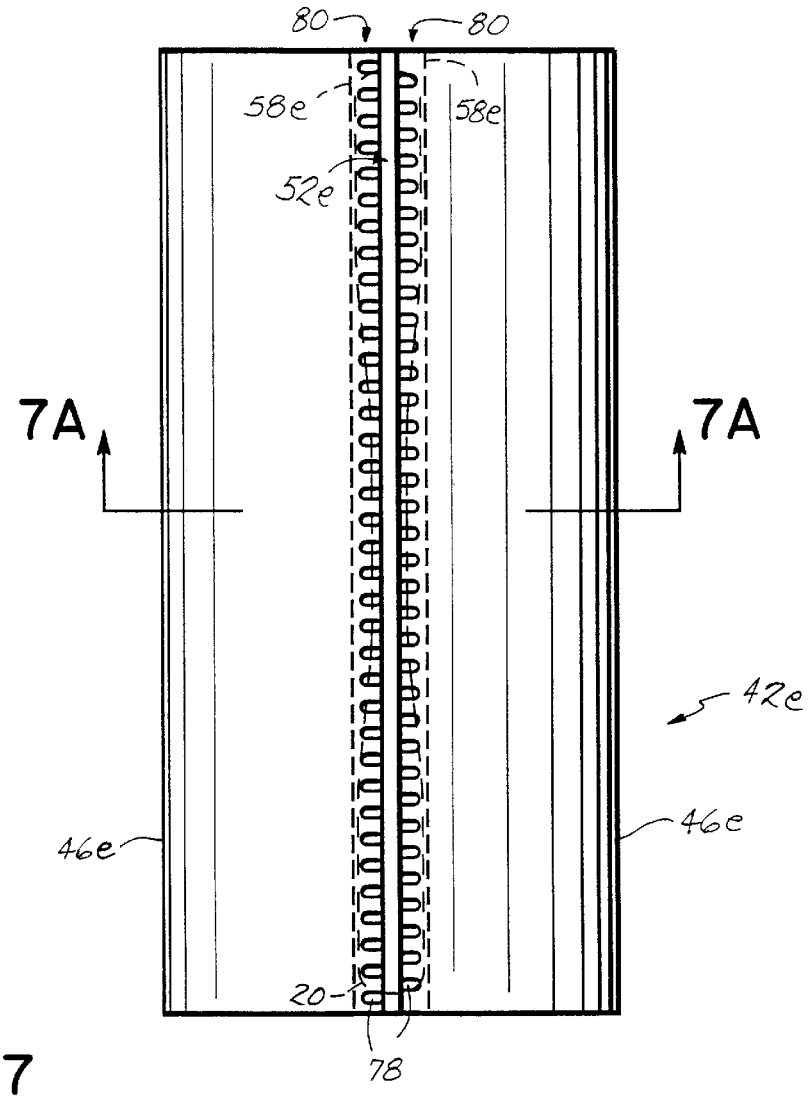
FIG. 7 is a view similar to FIG. 3, illustrating a reflector in accordance with a fifth aspect of the present invention.
Figure 7A:
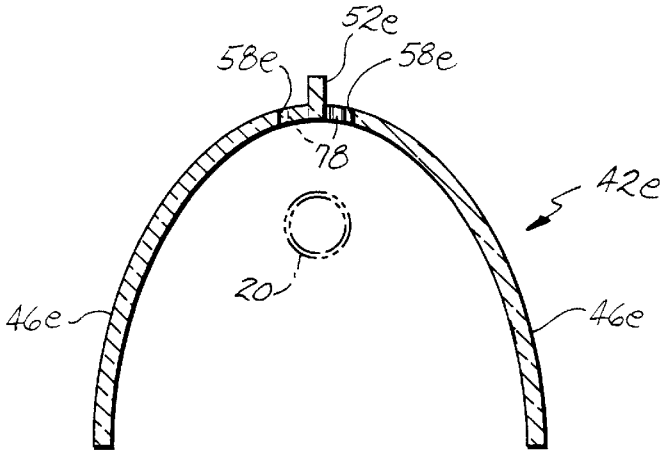
FIG. 7A is a cross-sectional view taken along line 7A—7A of FIG. 7.

Referring now to FIGS. 7 and 7A, a reflector 42*e* in accordance with yet another aspect of the present invention is shown. In this embodiment, the reflector 42*e* includes a pair of longitudinally extending reflector panels 46*e*that are mounted in opposing relationship, and are connected to an intermediate member 52*e* along its opposite longitudinal edges 58*e*. Intermediate member 52*e* may be made of a fluoro polymer, such as TEFLON®, and may also be made non-reflective. The reflector panels 46*e*and intermediate member 52*e* are mounted within the microwave chamber 14 and in spaced relationship to the plasma lamp bulb 20. The intermediate member 52*e* includes apertures 78 formed therethrough that are operable to pass air toward the plasma lamp bulb 20 so that the air envelops the plasma lamp bulb 20 effectively entirely about its outer surface to cool the bulb 20. The apertures 78 are provided in at least two longitudinally extending rows 80 that are each preferably aligned generally parallel with and offset from the longitudinal axis of plasma lamp bulb 20. The apertures 78 on one row 80 may be staggered relative to the apertures 80 of the other row as shown in FIG. 7. Of course, other configurations of the apertures 78 and the rows 80 are possible to achieve a similar result without departing from the spirit and scope of the present invention.

The reflector configurations of the present invention provide improved cooling of the plasma lamp bulb 20 by enveloping the bulb 20 with air effectively entirely about its outer surface. Each reflector configuration includes a pair of longitudinally extending slots that pass air in a desired manner toward the plasma lamp bulb 20. The reflector configurations of the present invention provide efficient cooling of the plasma lamp bulb 20 that reduces the amount of cooling air required to operate the plasma lamp bulb 20 at a predetermined power level. Moreover, the efficient cooling provided by the reflector configurations of the present invention improve the life of the plasma lamp bulb 20.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, we claim:

1. An apparatus for generating ultraviolet radiation, comprising:

a longitudinally extending microwave chamber;

a longitudinally extending plasma lamp bulb mounted within said microwave chamber;

at least on microwave generator coupled to said microwave chamber and operable to generate a microwave energy field within said chamber for exciting said plasma lamp bulb to emit ultraviolet radiation from a bottom end said chamber; and a reflector mounted in said microwave chamber operable to reflect ultraviolet radiation generated by said plasma light bulb, said reflector comprising a first longitudinally extending reflector panel mounted in spaced relationship to said plasma bulb, a second longitudinally extending reflector panel mounted in opposing and mirror facing relationship to said first reflector panel and in spaced relationship to said plasma bulb, and a longitudinally extending intermediate member mounted in spaced relationship to said first and second reflector panels and to said plasma lamp bulb, said first and second reflector panels and said intermediate member forming in mounted combination a pair of longitudinally extending slots operable to pass air toward said plasma lamp bulb.

2. The reflector assembly of claim 1 wherein each of said first and second reflector panels has a longitudinally extending edge that is parallel to a longitudinal axis of said respective reflector panel.

3. The reflector assembly of claim 1 wherein each of said first and second reflector panels has a longitudinally extending edge configured with at least one projection or recess formed along the longitudinal length of said edge.

4. The reflector of claim 1 wherein said intermediate member has a pair of longitudinally extending opposite edges that are each parallel to a longitudinal axis of said intermediate member.

5. The reflector of claim 2 wherein said intermediate member has a pair of longitudinally extending opposite edges that are each configured with at least one projection or recess formed along the longitudinal length of said edge.

6. The reflector of claim 3 wherein aid intermediate member has a pair of longitudinally extending opposite edges that are each configured with at least one projection or recess formed along the longitudinal length of said edge.

7. The reflector of claim 6 wherein said at least one projection formed along the longitudinal length of said first and second reflector panel edges are adapted to be mounted in opposing relationship to said at least one recess formed along the longitudinal length of each of said intermediate member edges.

8. The reflector of claim 6 wherein each of said longitudinally extending edges of said first and second reflector panels and said intermediate member has a generally sinusoidal configuration.

9. The reflector of claim 1 wherein said intermediate member has a generally rectangular configuration in transverse cross-section.

10. The reflector of claim 1 wherein said intermediate member has a generally circular configuration in transverse cross-section.

11. The reflector of claim 1 wherein said intermediate member is made non-reflective.

12. An apparatus for generating ultraviolet radiation, comprising:

a longitudinally extending microwave chamber;

a longitudinally extending plasma lamp bulb mounted within said microwave chamber;

at least one microwave generator coupled to said microwave chamber and operable to generate a microwave energy field within said chamber for exciting said plasma lamp bulb to emit ultraviolet radiation from a bottom end said chamber; and a reflector mounted in said microwave chamber operable to reflect ultraviolet radiation generated by said plasma light bulb, said reflector comprising a first longitudinally extending reflector panel mounted in spaced relationship to said plasma bulb, a second longitudinally extending reflector panel mounted in opposing and mirror facing relationship to said first reflector panel and in spaced relationship to said plasma bulb, and a longitudinally extending intermediate member connected to said first and second reflector panels and mounted in spaced relationship to plasma lamp bulb, said intermediate member having a plurality of apertures extending therethrough operable to pass air toward said plasma lamp bulb.

13. The reflector of claim 12 wherein said intermediate member has at least two longitudinally extending rows of apertures extending therethrough.

14. The reflector of claim 13 wherein said apertures of one longitudinally extending row are staggered relative to said apertures of said other longitudinally extending row.

15. The reflector of claim 12 wherein said intermediate member is made non-reflective.

16. A method of cooling a plasma lamp bulb in a microwave excited ultraviolet lamp system having a microwave chamber, a reflector mounted in the microwave chamber and a pair of longitudinally extending slots formed in the reflector, comprising:

passing air in a direction through one of the longitudinally extending slots toward the plasma lamp bulb;

passing air in the same direction through the other longitudinally extending slot toward the plasma lamp bulb; and enveloping the plasma lamp bulb effectively entirely about its outer surface to cool the plasma lamp bulb.

17. The method of claim 16 further comprising the step of passing the air through the pair of slots on opposite longitudinal sides of the plasma lamp bulb.

* * * * *

UNITED STATES PATENT AND TRADEMARK OFFICE

CERTIFICATE OF CORRECTION

PATENT NO. : 6,696,801 B2
DATED : February 24, 2004
INVENTOR(S) : James W. Schmitkons et al.

It is certified that error appears in the above-identified patent and that said Letters Patent is hereby corrected as shown below:

Title page,
Item [57], ABSTRACT,
Line 5, change “space” to -- spaced --.

Column 2,
Line 48, change “form” to -- from --.

Column 5,
Line 10, delete “the”.
Line 19, after “may” insert -- be --.
Line 48, change “form” to -- from --.
Line 52, after “as” insert -- a --.

Column 7,
Line 49, change “46ethat” to -- 46e that --.
Line 54, change “46eand” to -- 46e and --.

Column 8,
Line 14, change “improve” to -- improves --.
Line 34, change “on” to -- one --.
Line 38, after “end” insert -- of --.

Column 9,
Line 3, change “aid” to -- said --.
Line 35, after “end” insert -- of --.

Signed and Sealed this

Twelfth Day of April, 2005

JON W. DUDAS
*Director of the United States Patent and Trademark Office*